United States Patent [19]

Ryberg et al.

[11] Patent Number: 4,516,000

[45] Date of Patent: May 7, 1985

[54] STARTER SWITCH ARRANGEMENT

[75] Inventors: Bertil Ryberg, Torslanda; Kenth Mellgren, Kungsbacka, both of Sweden

[73] Assignee: Aktiebolaget Volvo Penta, Gothenburg, Sweden

[21] Appl. No.: 530,644

[22] Filed: Sep. 9, 1983

[30] Foreign Application Priority Data

Sep. 16, 1982 [SE] Sweden ..... 8205297

[51] Int. Cl.[3] ..... E05B 19/26

[52] U.S. Cl. ..... 200/44; 70/408; D8/347; 200/302.1

[58] Field of Search ..... 70/423, 424, 455, 408; 200/302.1, 44

[56] References Cited

U.S. PATENT DOCUMENTS

| | | | |
|---|---|---|---|
| 1,094,478 | 4/1914 | Ryan | 70/408 |
| 1,365,949 | 1/1921 | Pichl | 70/408 |
| 2,988,910 | 6/1961 | Eshbaugh et al. | 70/455 |
| 3,394,565 | 7/1968 | Turman | D8/347 |
| 3,423,973 | 1/1969 | Ancliff | 70/408 |
| 3,475,934 | 11/1969 | Reisner | 70/455 |
| 3,630,053 | 12/1971 | Krakauer | 70/408 |

FOREIGN PATENT DOCUMENTS

| | | | |
|---|---|---|---|
| 2644794 | 6/1978 | Fed. Rep. of Germany | 70/408 |
| 698202 | 1/1931 | France | 70/424 |

*Primary Examiner*—John W. Shepperd
*Assistant Examiner*—Renee S. Kidorf

[57] ABSTRACT

A starter switch arrangement for boats, where the switch may be subjected to water splash or the like. The arrangement includes a key with a gripping component and an insert component to be inserted into an aperture in the switch for opening and locking the switch. The key has a cover component positioned between the gripping and insert components and provided to be sealingly supported against the switch in the inserted position of the key during the utilization of the boat. The cover component will sealing close a portion of the switch around the aperture of the switch.

14 Claims, 6 Drawing Figures

STARTER SWITCH ARRANGEMENT

BACKGROUND OF THE INVENTION

The present invention relates to a starter switch arrangement for boats, where the switch is so positioned that upon utilization of the boat it risks to be subjected to water splash or the like, said switch including a key with a gripping component and an insert component which is provided to be inserted into an aperture in the switch and which has a shape fitting individually to the present switch, so that the switch can be opened and locked respectively by means of the key.

A starter switch positioned in a difficult and unprotected environment will deteriorate with regard to its reliability and function as time passes by due to the fact that foreign bodies will find their way into the starter switch and will cause corrosion, contamination and the like, resulting in the seizure of the moving parts of the starter switch. For instance, in boats of a kind in which the starter switch is in an unprotected position, water in the form of spray or rain may easily find its way into the switch and cause corrosion. Starter switches have been protected in certain cases by means of a removable protective cover, although this will only protect the starter switch when the ignition key is not in place, with the result that the degree of protection afforded is extremely limited. It is in boats in particular that the starter switch is often most exposed when the ignition key is in the switch, that is to say when the boat is travelling on the water. Attempts have been made to eliminate the corrosion problem by developing a switch made entirely of plastic, although this was unable to satisfy other requirements, such as the strength of the switch, for instance when exposed to acts of violence.

The object of the present invention is to propose a starter switch arrangement for boats by means of which the starter switch will not be affected by adverse environmental conditions during the utilization of the present boat.

BRIEF SUMMARY OF THE INVENTION

This object is achieved by means of the starter switch arrangement according to the present invention which is characterized in that the key for opening and locking the switch has a cover component which is positioned between the gripping component and the insert component and provided to be sealingly supported against the switch in the inserted position of the key during the utilization of the boat and in this way sealingly closes a portion of the switch around said aperture.

BRIEF DESCRIPTION OF THE DRAWING

The invention is described below in greater detail in relation to a typical embodiment, with reference to the accompanying drawings, in which.

DETAILED DESCRIPTION OF A PREFERRED EMBODIMENT

Figure 1:
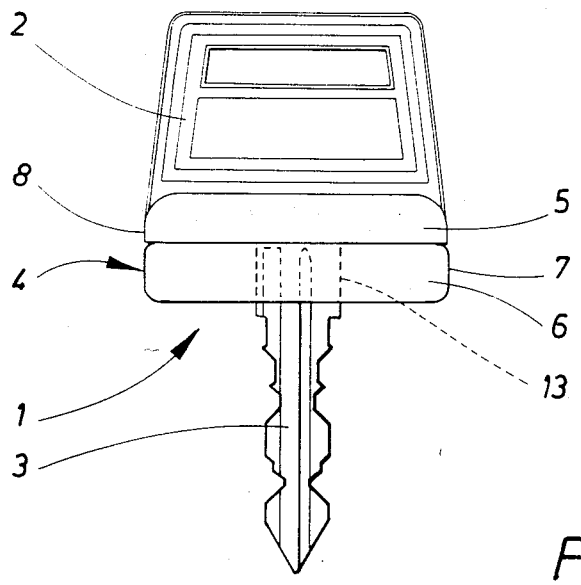
FIG. 1 shows a side view of a key belonging to a starter switch, said key being provided with an arrangement in accordance with the present invention.
Figure 2:
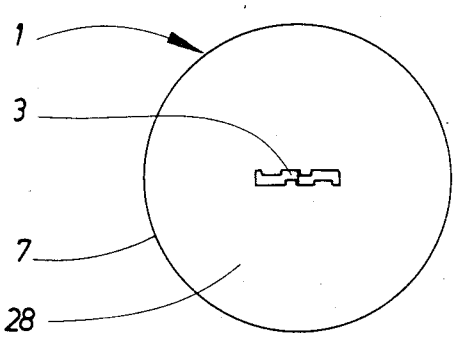
FIG. 2 shows an end view of the key in accordance with FIG. 1.

The structure of a key 1 incorporated in the arrangement in accordance with the invention is illustrated by the typical embodiment shown in FIG. 1 and FIG. 2. The key has in a conventional manner a gripping component 2 and an insert component 3. The gripping component is intended to be gripped in the hand between the thumb and the index finger in order to enable the key to be moved in and out of the associated starter switch. The insert component 3 has for each individual switch in a given series an individual shape in the form of notched recesses, by means of which the starter switch can be operated and the contact function associated with the starter switch can be switched over. By means of the key the starter switch can be locked and made unavailable to unauthorized persons. In accordance with the invention the key has a collar-like or flange-like cover 4 having a number of functions which are described in greater detail below. The cover 4 is situated between the gripping component 2 and the insert component 3 and has as its principal function the protection of the starter switch against the ingress of foreign bodies by covering at least part of the front face of the starter switch, which is described in greater detail below. The cover consists in the typical embodiment shown of a supporting component 5 and an elastic sealing component 6 located in front of it. The supporting component 5 forms a support for the elastic sealing component 6, which is executed in a relatively soft and flexible material which should preferably have sealed cells. The material used may be a plastic foam, for instance, such as polyethylene foam. In this way water cannot be absorbed by the elastic sealing component 6, enabling it to act as a float for the key 1. The float will provide sufficient buoyancy in water for the key to float in the event of it being dropped overboard from a boat, for instance.

The supporting component 5 is in the typical embodiment shown entirely integrated with the gripping component 2 and forms a flange section in front of it. The gripping component and the flange section are executed in a comparatively rigid material, which should nevertheless exhibit a small degree of flexibility, for example an ethylene plastic such as Lupolene. Both the supporting component 5 and the sealing component 6 have a circular external contour, whereas the edge section 7 at the periphery of the sealing component has essentially the same external diameter as the edge section 8 of the cover. The execution of the key 1 viewed from the front is shown in FIG. 2. This figure principally illustrates the surface of the sealing component 6 which faces to the front, said surface being flat and circular and forming the sealing surface 28 of the sealing component.

Figure 3:
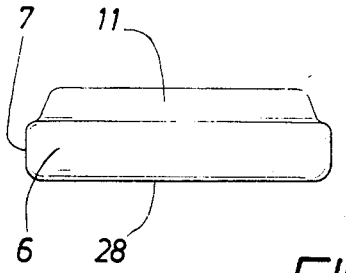
FIG. 3 shows a side view of a sealing component forming part of the arrangement.
Figure 4:
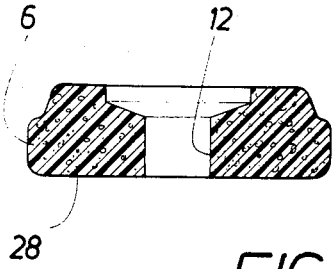
FIG. 4 shows a central cross-section through the sealing component in accordance with FIG. 3.

FIG. 3 shows the sealing component separately in side view, whereas FIG. 4 shows a central cross-section through the sealing component. It will be appreciated that the sealing component 6 is shaped in a particular way so as to fit not only the supporting component 5 but also the insert component 3. As may be seen from FIG. 5 and FIG. 6 the supporting component 5 is in fact cup-shaped with a concave space 9 facing towards the insert component 3, said concave space being defined by its bottom surface 10 and by the aforementioned peripheral edge section 8. Into this space 9 projects the sealing component 6 together with a securing component 11, which has a progressively smaller diameter in a direction away from the outer edge section 7 of the sealing component. This securing component 11 thus has a shape which is a perfect fit with the shape of the space 9 and is designed to be secured to its bottom surface 10 and to the inner wall of the edge section 8 by means of a bonding agent, for instance a contact adhesive. As may best be appreciated from FIG. 4, the sealing component 6 has a transverse slotted aperture 12, of which the shape matches a part 13 of the key which forms the transition between insert component 3 and the gripping component 2. The contact between the sealing component 6 and the rest of the key is such that sealing will occur between the sealing component and the remaining parts of the key either at the contact surface with the internal surfaces of the supporting component 5 or at the part 13 of the key between the gripping component 2 and the insert component 3. Leakage into the switch from outside or the ingress of other foreign bodies is thus prevented via the aperture 12. The cup-shaped form enables the supporting component 5 to possess excellent rigidity, in spite of the relatively thin wall thickness specified for the material. The cup-shaped design provides good protection for the sealing component 6, which in turn can be provided with adequate volume to ensure its buoyancy.

Figure 5:
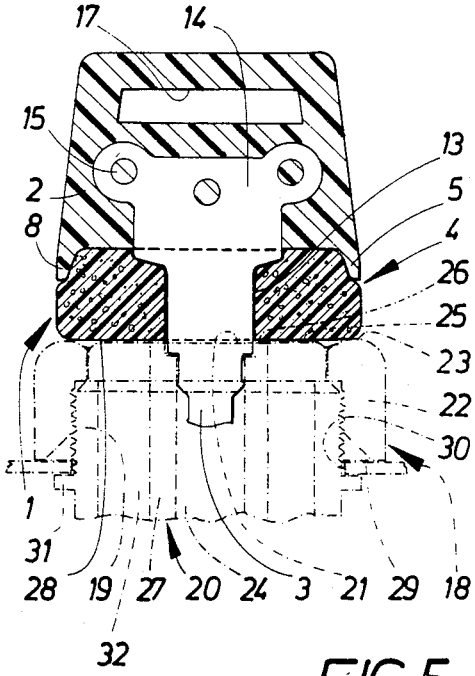
FIG. 5 shows a section through the key with the arrangement in accordance with the invention in sealing contact with the starter switch.
Figure 6:
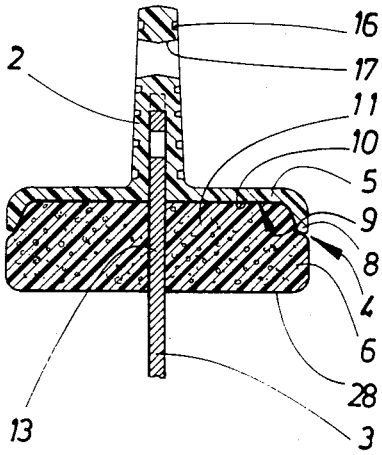
FIG. 6 shows a cross-section in accordance with FIG. 5 on which is superimposed a cross-section through the key, which is shown partly sectioned.

FIG. 5 and FIG. 6 best indicate the manner in which the various component parts of the key 1 fit togehter. The insert component 3 consists of a shaped piece of flat metal with an inner end part 14 with three apertures 15, while the gripping component 2 is executed as a piece of plastic, moulded flush onto the end part 14 of the piece of metal in such a way that the piece of plastic encloses the surfaces of the end part and also enters the apertures 15. The gripping component has been given a comfortable form with a number of grooves 16 to improve the grip and also an opening 17 enabling it to be attached to a key-ring or the like.

FIG. 5 also shows the key 1 inserted into the operating position in a starter switch 18, of which part is indicated in the figure by means of dotted and dashed lines. The starter switch 18 is executed in the typical embodiment shown in the form of a cylinder lock with a cylinder barrel 19 and a lock cylinder 20. The lock cylinder 20 has a groove 24 with a slotted aperture 21 through which the key is introduced into the starter switch by means of its insert component 3. The internal structure of the starter switch is of entirely conventional nature and will not require any more detailed description except for certain components which concern the present invention. The lock cylinder 20 is supported by a central part 27 in the cylinder barrel 19 in such a way that it is free to rotate, thereby enabling it to be turned between the positions for the different functions for the purpose of connecting different functions by means of an electrical contact unit (not shown), for example ignition, starter motor and similar functions. By means of sensor organs (not shown) in the lock cylinder 20, the presence of the correct key is sensed in a previously disclosed manner, thereby permitting said correct key to be introduced and turned so that the functions concerned can be engaged. The cylinder barrel 19 is surrounded by a locking ring 22 executed in the form of a round nut, which is screwed onto the cylinder barrel and is designed to secure the starter switch in a hole 30 in a panel 29 or similar. The switch is secured in place by clamping the starter switch in position by causing the locking ring 22 to bear against a flange 31 in the cylinder barrel 19.

As may be appreciated from FIG. 5 the clamping ring 22 is situated with its front annular surface 23 slightly proud of the remaining front surfaces of the starter switch 18, in particular the front surface 25, 26 of the fixed and moving parts respectively of the lock cylinder 20. When the key 1 is introduced into the starter switch 18 through the aperture 21 in such a way that the key can be turned, taking with it the moving part 27 of the lock cylinder 20, the cover 4 will move into very close contact with the starter switch 18 through the circular sealing surface 28 of the sealing component. In the typical embodiment shown, sealing against the front surface 23 of the clamping ring 22 of the starter switch 18 is achieved without any contact taking place with the front surfaces 25, 26 of the lock cylinder 20. Because the effective sealing surface between the locking ring 22 and the sealing surface 28 of the sealing component 6 is situated in the outer part of the starter switch when viewed radially, complete sealing against the environment is achieved for the front surfaces of the starter switch as a whole, whereby not only the aperture 21 for the key is protected, but also the other exposed component parts of the starter switch, especially the interface between the moving part 27 and the fixed part 32 of the lock cylinder 20, which form a bearing surface, and the interface between the lock cylinder 20 and the locking ring 22. The annular, effective sealing surface is comparatively small, which, in combination with the choice of low-friction characteristics and a high degree of elasticity in the sealing component, resulting in contact pressure, produces low frictional forces. The reduction of the frictional forces to the minimum possible level is of enormous advantage, since it is important that the function of the starter switch when the key is turned and returns under spring bias in the opposite direction to that in which it was turned should not in any way be hindered by the contact with the sealing component 6. FIG. 5 illustrates a theoretically perfect situation, in which contact takes place without any significant deformation of the sealing component 6. In practice, however, there must always be a small amount of flexibility in the contact surface of the sealing component if complete sealing is to be guaranteed.

By selecting a type of material with sealed cells for the sealing component 6, as indicated above by way of example, this will ensure, in addition to its function as a float through its inability to absorb water, the additional significant advantage that the sealing component is unable in its operating position to give off moisture which could find its way into the starter switch.

In accordance with the invention, the cover 4 in conjuncture with the integrated design of the gripping component 2 produces an outer contour with a shape which will make good contact with the maximum transverse dimension of the starter switch outside the panel 30, this being the diameter of the locking ring 22. The starter lock with the key 1 reduces progressively outwards from this dimension in a most harmonious fashion so as to avoid the presence of any abruptly narrower sections in which objects such as lines or similar could become caught.

In summary the arrangement in accordance with the present invention provides the principal function that the starter switch in its operating mode, that is to say with the key introduced, will be provided with a very high degree of protection against foreign bodies such as water, dust, dirt and the like, by the sealing of that part of the starter switch which is outside the panel. By simultaneously executing the cover as a float, a key which is lost overboard can be prevented from sinking in the water. The key as a unit is also made more stable in an advantgeous manner through the existence of contact between the cover and the starter switch, which is particularly desirable in the case of certain types of vehicle in which the key may be exposed to blows of shocks which might otherwise cause the insert component to break off. The cover also eliminates the risk present in conventional keys of foreign objects becoming caught up in it. These characteristics are particularly desirable in marine applications, for instance in boats fitted with engines, where the starter switch is in an exposed position, although other applications are also conceivable in which the starter switch is exposed to quite severe environmental conditions, for example in a contractor's plant.

The invention is not restricted to the typical embodiment specified above and illustrated in the drawings, but may be modified within the context of the following claims. For example, the cover may instead be executed as a single piece, for example in the form of a bellows, or may have an annular lip seal which provides a seal against a surface on the locking ring or some other part of the front surface of the starter switch. For example, the entirely flat sealing surface shown in the drawings may be replaced by a number of annular beads which are concentric with one another. It is also conceivable for the sealing component and the front surface of the starter switch to fit together in such a way that the sealing component will make sealing contact with the entire front surface of the starter switch. The embodiment specified above proposes axial sealing, although radial seals are also possible, whereby the locking ring may, for example, be provided with an O-ring on its surface in the form of a cylinder jacket and the cover may have a collar which passes over the locking ring. It is also conceivable for sealing to be achieved by means of such a collar without an O-ring being necessary. Instead of making the sealing component flexible, the contact surface between the starter switch and the cover may be provided with a flexible part.

We claim:

1. A starter switch arrangement for environments where a switch may be subject to intrusion of water, such as for a boat or the like during its utilization, said switch arrangement including: a switch, a key having a gripping component, an insert component to be inserted into an aperture in the switch for opening and locking the switch, and a cover component integrated with and positioned between said gripping component and said insert component, said cover component having a portion which is resilient in axial direction of the key and presents a soft resilient surface generally parallel to and provided to abut against a front surface of the switch in the inserted position of the key, said resilient surface being arranged for sealingly supporting the cover component against the switch in the inserted position of the key and sealingly close at least a major portion of the front surface of the switch around said aperture.

2. An arrangement according to claim 1, wherein the cover component has a collar or flange-like shape and has a comparatively stiff supporting portion, and an elastic portion positioned between the supporting portion and the insert component.

3. An arrangement according to claim 2, wherein the resilient surface, in the inserted position of the key is adapted to sealingly contact a peripheral annular portion protruding from the front surface of the switch.

4. An arrangement according to claim 2, wherein the resilient sealing surface is a surface causing relatively low friction upon engagement with the front surface of the switch.

5. An arrangement according to claim 4, wherein the sealing surface is substantially plane and circular.

6. An arrangement according to claim 2, wherein the supporting portion of the cover component and the gripping component are of one piece, which is symmetric with respect to a tangential and a normal plane of the insert component in axial direction of the key, and which displays a certain degree of flexibility, said cover component and gripping component having radially generally gradually decreasing dimensions in at least said tangential and normal planes in the axial direction away from the insert component of the key.

7. An arrangement according to claim 6, wherein said supporting portion consists of ethylene plastic.

8. An arrangement according to claim 2, wherein the supporting portion is cup shaped and faces the insert component with a concave side and having an annular edge portion to partly enclose the elastic portion.

9. An arrangement according to claim 8, wherein the elastic portion is substantially disc shaped and has a thickness which exceeds the depth of the cup-shaped supporting portion.

10. An arrangement according to claim 8, wherein the sealing surface has substantially the same outer diameter as the annular edge portion of the supporting portion.

11. An arrangement according to claim 2, wherein the cover component forms a floating body for the key.

12. An arrangement according to claim 11, wherein the elastic portion of the cover component forms said floating body.

13. An arrangement according to claim 11, wherein the elastic portion consists of a material with closed cells.

14. An arrangement according to claim 13, wherein said material is foam plastics.

* * * * *